US006244336B1

(12) United States Patent
Kachich

(10) Patent No.: US 6,244,336 B1
(45) Date of Patent: Jun. 12, 2001

(54) DOUBLE SHEARING RAMS FOR RAM TYPE BLOWOUT PREVENTER

(75) Inventor: Albert J. Kachich, Katy, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/520,068

(22) Filed: Mar. 7, 2000

(51) Int. Cl.[7] ..... E21B 29/08
(52) U.S. Cl. ..... 166/55; 166/85.4
(58) Field of Search ..... 166/55, 55.1, 85.4, 166/317, 323

(56) References Cited

U.S. PATENT DOCUMENTS

| | | | | |
|---|---|---|---|---|
| 3,561,526 | * | 2/1971 | Williams, Jr. et al. | 166/55 |
| 3,817,326 | * | 6/1974 | Meynier, III | 166/55 |
| 4,081,027 | * | 3/1978 | Nguyen | 166/55 |
| 4,132,266 | * | 1/1979 | Randall | 166/55 |
| 4,132,267 | | 1/1979 | Jones . | |
| 4,215,749 | | 8/1980 | Dare et al. . | |
| 4,240,503 | * | 12/1980 | Holt, Jr. et al. | 166/55 |
| 4,313,496 | | 2/1982 | Childs et al. . | |
| 4,347,898 | | 9/1982 | Jones . | |
| 4,508,313 | | 4/1985 | Jones . | |
| 4,580,626 | | 4/1986 | Jones . | |
| 4,646,825 | * | 3/1987 | Van Winkle | 166/55 |
| 5,360,061 | * | 11/1994 | Womble | 166/55 |
| 5,501,424 | | 3/1996 | Williams et al. . | |
| 5,515,916 | | 5/1996 | Haley . | |
| 5,803,431 | | 9/1998 | Hoang et al. . | |

OTHER PUBLICATIONS

Cooper Cameron Corp., BOP Replacement Parts Catalog, Jul. 1998, p. 41, "T BOP Shearing Blind Rams".

* cited by examiner

*Primary Examiner*—Frank Tsay
(74) *Attorney, Agent, or Firm*—Jackie Lee Duke

(57) ABSTRACT

Double shearing rams designed for use in a standard ram-type blowout preventer used in oil and gas drilling and workover operations are disclosed. The double shearing rams include an upper shear ram and a mating lower shear ram. The upper shear ram includes an upper cutting blade and a lower guide blade vertically spaced to form a cavity therebetween. The cavity is sized to receive the lower ram's cutting blade in close fitting engagement when the rams are closed. The upper shear ram has a primary cutting edge formed on its leading edge and a secondary edge vertically and axially displaced from the primary cutting edge. During shearing operations, initial movement of the shear rams allows the upper shear ram's primary cutting edge to cooperate with the lower shear ram's cutting blade to make an initial shear of the member or members in the blowout preventer's bore. Further closing of the shear rams allows the upper shear ram's secondary cutting edge to cooperate with the lower shear ram's cutting blade to make a second shear of any remaining member or members in the blowout preventer's bore. A plurality of guide pins positioned on the upper shear ram and the lower shear ram notched cutting edge cooperate to maintain the members to be sheared between the upper and lower shear ram.

19 Claims, 6 Drawing Sheets

DOUBLE SHEARING RAMS FOR RAM TYPE BLOWOUT PREVENTER

BACKGROUND OF THE INVENTION

1. Field of the Invention

This invention relates to an improved shear ram cutting blade configuration for use in a shearing ram for a ram-type blowout preventer used in oil and gas drilling and workover operations. Ram-type blowout preventers are part of a pressure control system used in oil and gas drilling operations to control unexpected well bore pressure spikes or "kicks" as they are commonly referred to in the industry.

The blowout preventer has a body with a vertical bore and a pair of laterally disposed opposing bonnet assemblies. Each bonnet assembly includes a piston which is laterally moveable within the bonnet assembly by pressurized hydraulic fluid. The opposite end of the pistons each have a connecting rod attached thereto which in turn has a shear ram mounted thereon. These shear rams are designed to shear or cut through any member, such as tubing or seismic logging cable, disposed within the blowout preventer body's vertical bore. This sudden closing of the rams is necessary when a well bore pressure spike or kick is detected during downhole operations such as well logging or well maintenance. Due to the need to rapidly seal the well bore, there is insufficient time to retrieve the aforementioned tubing or cable from the well bore before closing the rams. Therefore it is necessary to have shear rams that can cleanly cut through these members and seal the well bore.

These shear rams face a difficult task. Recent requirements promulgated by some drilling contractors include the ability of the shear rams to shear up to ten strands of cable, multiple strings of steel tubing or a combination of the two, or multiple strings of a composite tubing with electrically conducting wires in the wall. Each of these requirements poses similar yet different requirements on the shear rams. In the case of multiple strands of cable the flexibility of the cable along with its inherent toughness makes it particularly difficult to shear or cut cleanly without leaving partially cut strands of the cable in the blowout preventer bore and thereby making it especially difficult for the shear rams to seal after the cutting or shearing operation. Shearing multiple strings of tubing poses an almost opposite problem in that their rigid structure causes the individual strings of tubing to flatten and extend beyond the outer edges of the shear ram cutter blades as they are initially squeezed by the blades. This can cause unsheared pieces of tubing to interfere with the closing operation of the shear rams and difficulties in sealing.

Thus, the shear rams in a ram-type blowout preventer must be able to cleanly shear a variety of members and seal the blowout preventer bore afterward in daily operation. The double shearing rams of the current invention offer a significant improvement over existing shear ram designs without requiring any changes to the existing blowout preventer design.

2. Description of Related Art

U.S. Pat. No. 5,501,424 to M. R. Williams et al. gate valve adapted for cutting wireline using an insert in the gate and seat for shearing a wireline cable disposed therein.

The shearing gate valve apparatus shown in U.S. Pat. No. 5,803,431 to L. G. Hoang et al. discloses a gate with a layer of hard facing material welded to the face of the gate to ensure the gate does not form an upset during shearing operations that would interfere with sealing operations.

SUMMARY OF THE INVENTION

The double shearing rams of the present invention are designed for use in a standard ram-type blowout preventer used in oil and gas drilling and workover operations. The blowout preventer has a body with an axial bore, a pair of opposing bonnet assemblies and a pair of opposing rams laterally moveable within the bonnet assemblies by a pressurized fluid source to control flow of well fluids through the blowout preventer body axial bore. The double shearing rams includes an upper shear ram operated by one bonnet assembly and an opposing lower shear ram operated by the other bonnet assembly. The lower shear ram is generally shaped like a rectangular parallelepiped with a pair of opposite sides rounded to fit the blowout preventer body. The lower shear ram includes a cutting blade on one side with a notched cutting edge formed on its leading edge.

The upper shear ram also is generally shaped like a rectangular parallelepiped with a pair of opposite sides rounded to fit the blowout preventer body. The upper shear ram includes an upper cutting blade and a lower guide blade vertically spaced to form a cavity therebetween. The cavity is sized to receive the lower ram's cutting blade in close fitting engagement when the rams are closed. The upper shear ram has a primary cutting edge formed on its leading edge and a secondary edge vertically and axially displaced from the primary cutting edge. During shearing operations, initial movement of the shear rams allows the upper shear ram's primary cutting edge to cooperate with the lower shear ram's cutting blade to make an initial shear of the member or members in the blowout preventer's bore. Further closing of the shear rams allows the upper shear ram's secondary cutting edge to cooperate with the lower shear ram's cutting blade to make a second shear of any remaining member or members in the blowout preventer's bore. A plurality of guide pins positioned on the upper shear ram and the cutting blade of the lower shear ram cooperate to maintain the members to be sheared between the upper and lower shear ram.

A principal object of the present invention is to provide improved shear rams for use in a ram-type blowout preventer that facilitates the clean and complete shearing of multiple cables in the blowout preventer bore with a double shearing configuration.

Another object of the present invention is to provide improved shear rams for use in a ram-type blowout preventer that facilitates the clean and complete shearing of multiple steel tubing strings in the blowout preventer bore with a retention mechanism to ensure the tubing strings stay between the shear rams until the shearing is complete.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
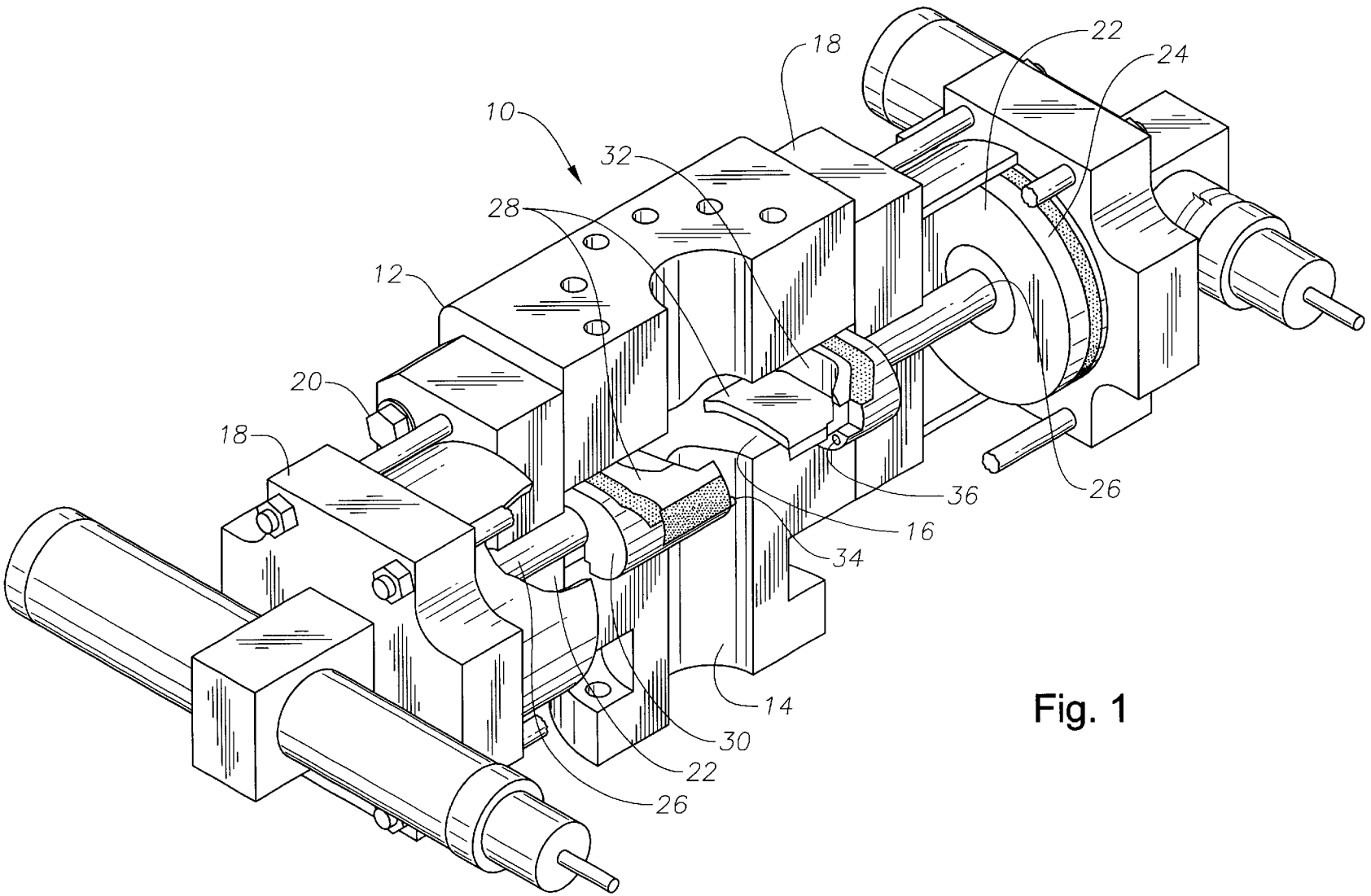
FIG. 1 is a perspective view with a cutaway section of a typical ram-type blowout preventer used in oil and gas drilling and workover operations utilizing the double shearing rams of the present invention.

With reference to the drawings, and particularly to FIG. 1, an isometric view of a ram type blowout preventer 10 used in oil and gas drilling and workover operations is shown. The ram type blowout preventer 10 includes a body or housing 12 with a vertical bore 14 and laterally disposed ram guideways 16. Bonnet assemblies 18 are mounted to the body 12 with studs 20 and aligned with laterally disposed guideways 16. Each bonnet assembly 18 includes an actuation means 22, including a piston 24 and connecting rod 26. Each connecting rod 26 is connected to a pair of shear rams 28. The pair of shear rams 28 includes upper shear ram 30 mounted one of the connecting rods 26 and a lower shear ram 32 mounted on the opposing connecting rod 26. Actuation means 22 allows upper shear ram 30 and lower shear ram 32 be reciprocated within guideways 16. Upper shear ram 30 includes guides pins 34 that mate with guide holes 36 of lower shear ram 32 in a manner to be described hereinafter.

Figure 2:
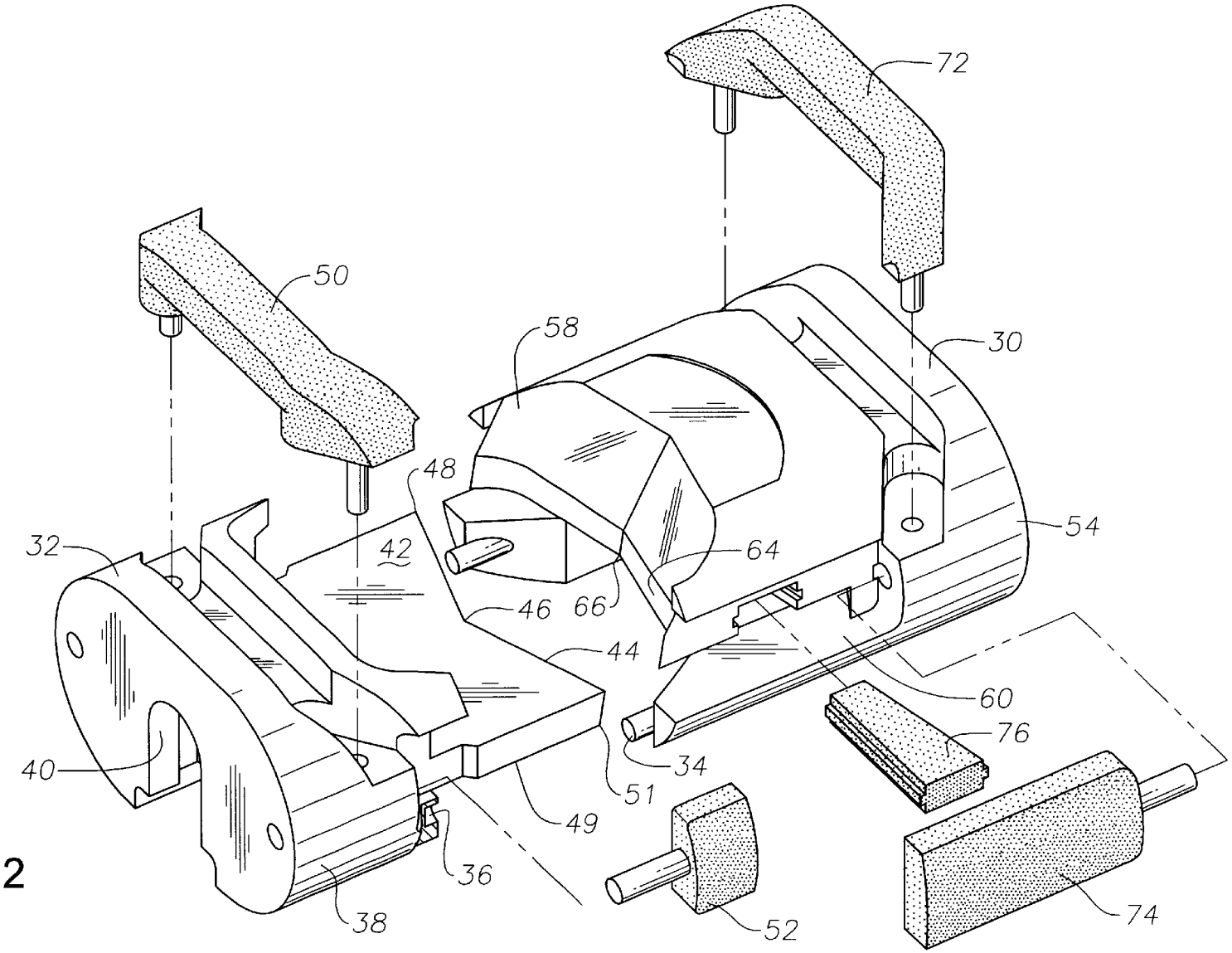
FIG. 2 is an exploded view of the double shearing rams.

Upper shear ram 30 and lower shear ram 32 are shown in an exploded view in FIG. 2 to aid in understanding the relationship between the parts. Lower shear ram 32 is a generally rectangular parallelepiped shape with rounded sides 38 that fit in laterally disposed ram guideways 16. A slotted key way 40 is formed in the rear of lower shear ram 32 for attachment to connecting rod 26. The front of lower shear ram 32 is machined to form cutting blade 42 with leading edge 44. Leading edge 44 has a wide "V" shape that forms notched cutting edge 46. Notched cutting edge 46 is inlayed with a substantially harder material on its top edge 48 and on each of two pads 49 on its bottom edge 51. This hardened top edge 48 aids during the shearing operation to be described hereinafter. Top seal 50 and side packer seals 52 are positioned on lower shear ram 32 to seal within guideways 16.

Upper shear ram 30 is a generally rectangular parallelepiped shape, similar to lower shear ram 32, with rounded sides 54 that fit in laterally disposed ram guideways 16. A slotted key way 56 (not shown) is formed in the rear of upper shear ram 30 for attachment to connecting rod 26. The front of lower shear ram 30 is machined to form upper cutting blade 58 and lower guide blade 60. Upper cutting blade 58 and lower guide blade 60 are vertically separated to form cavity 62 therebetween that accepts cutting blade 42 of lower shear ram 32 in close fitting engagement in a manner to be described hereinafter when upper shear ram 30 and lower shear ram 32 are closed.

Upper cutting blade 58 has leading edge 64 with a wide "V" shape that forms primary cutting edge 66. Secondary cutting edge 68 (See FIGS. 7 and 8) is formed on the underside of upper cutting blade 58 and is axially and vertically displaced from primary cutting edge 66. Primary cutting edge 66 and secondary cutting edge 68 are inlayed with a substantially harder material 70 to resist damage when shearing hard steel members. Top seal 72, side packer seals 74 and blade packer seals 76 combine to seal within guideways 16 and against lower shear ram 32 when the rams are closed.

Figure 3:
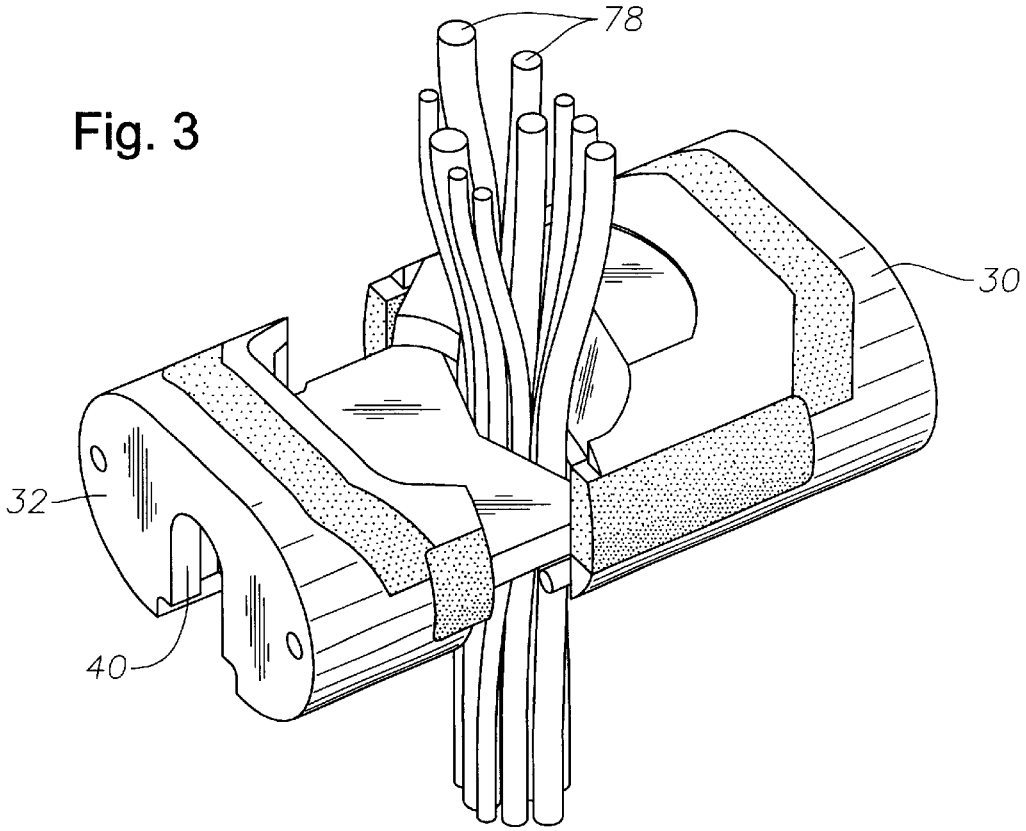
FIG. 3 is a perspective of the double shearing rams just prior to shearing of multiple cable strands.
Figure 4:
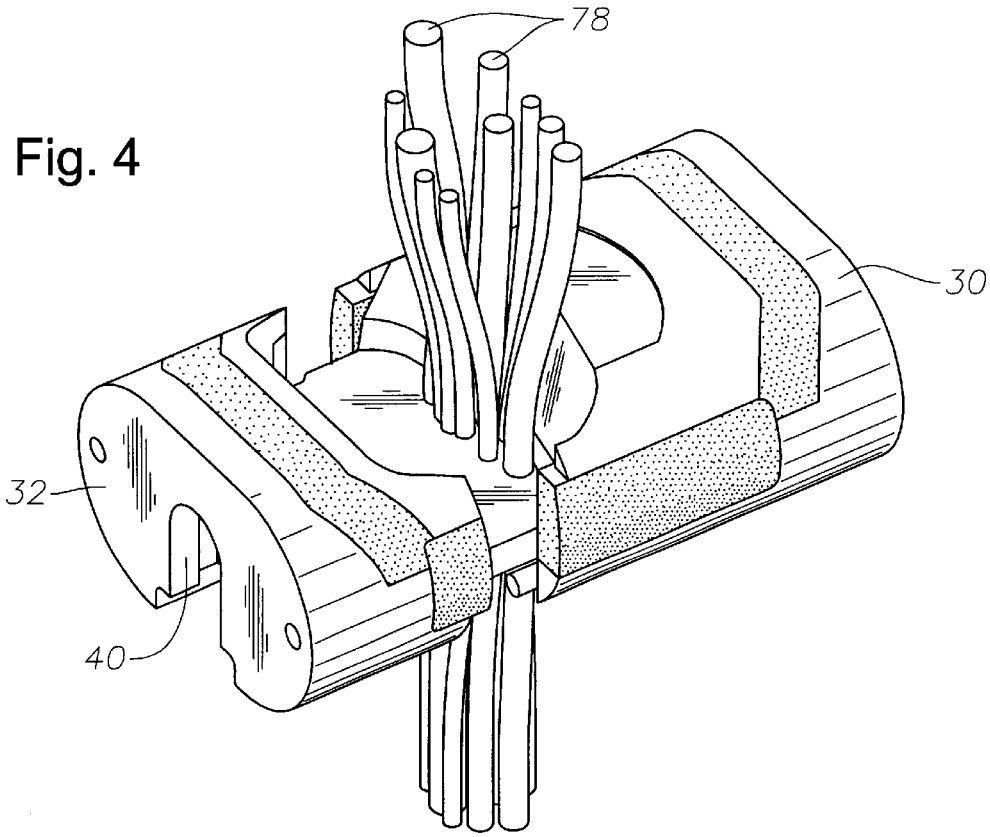
FIG. 4 is a perspective view of the double shearing rams after shearing of multiple cable strands.

Referring to FIGS. 3 and 4, upper shear ram 30 and lower shear ram 32 are shown with multiple members, specifically multiple strands of cable 78, positioned between them just prior to shearing. Guide pins 34 on upper shear ram 30 aid in keeping multiple cable strands 78 in position until shearing can be accomplished in FIG. 4. As upper shear ram 30 and lower shear ram 32 are closed the "V" shapes of the cutter blades also aid in keeping cable strands 78 in position for shearing.

Figure 5:
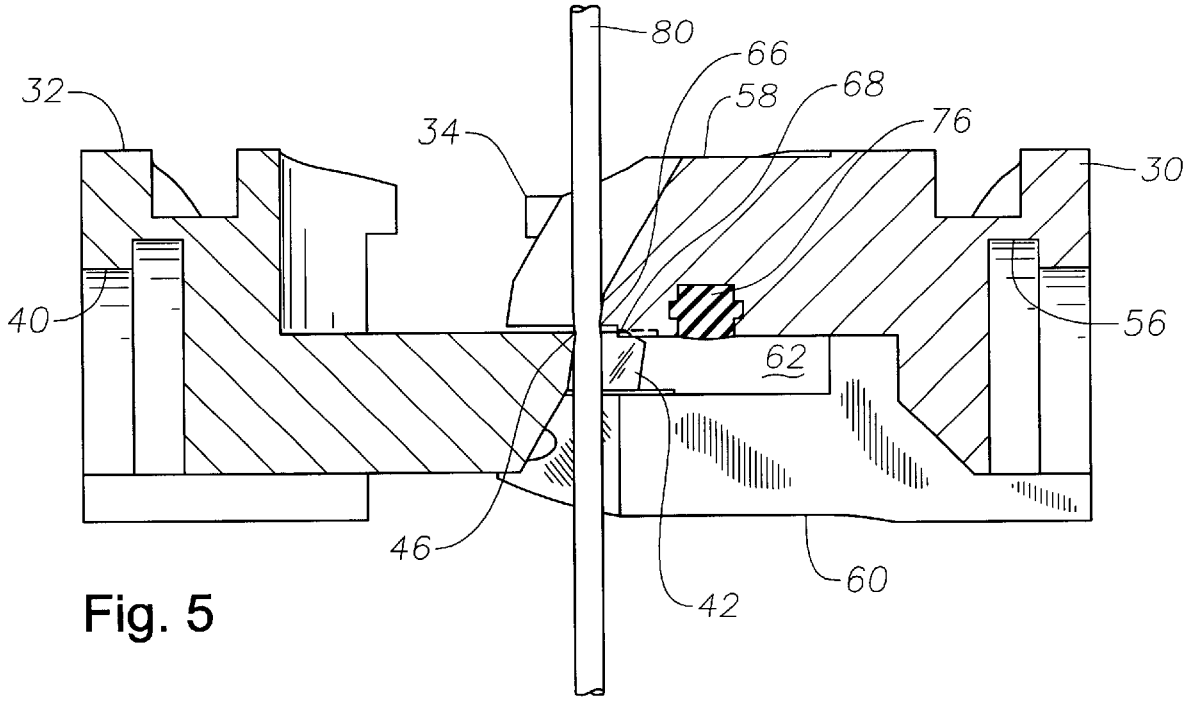
FIG. 5 is a side view of the double shearing rams just prior to shearing a wire cable.
Figure 6:
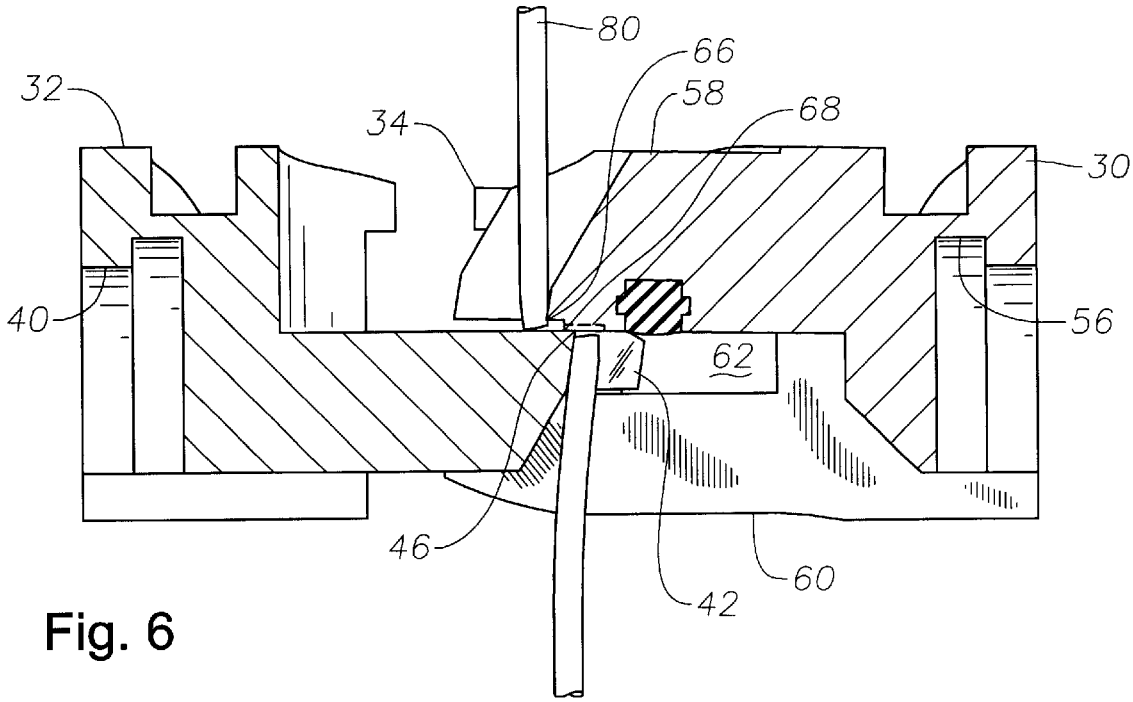
FIG. 6 is a side view of the double shearing rams just after shearing a wire cable.

The unique double shearing action of the present invention is best seen in FIGS. 5–8. A single strand of cable 80 is shown in FIG. 5 just prior to its initial shearing. Notched cutting edge 46 of lower shear ram 32 has cable strand 80 pressed against primary cutting edge 66 of upper shear ram 30. As upper shear ram 30 and lower shear ram 32 are forced together by actuation means 22, cutting edge 46 and primary cutting edge 66 perform an initial shear of cable strand 80. Further movement of upper shear ram 30 and lower shear ram 32 causes cable strand 80 to be subjected to a second shearing action between cutting edge 46 and secondary cutting edge 68 to ensure a complete cut as shown in FIG. 6.

Figure 8:
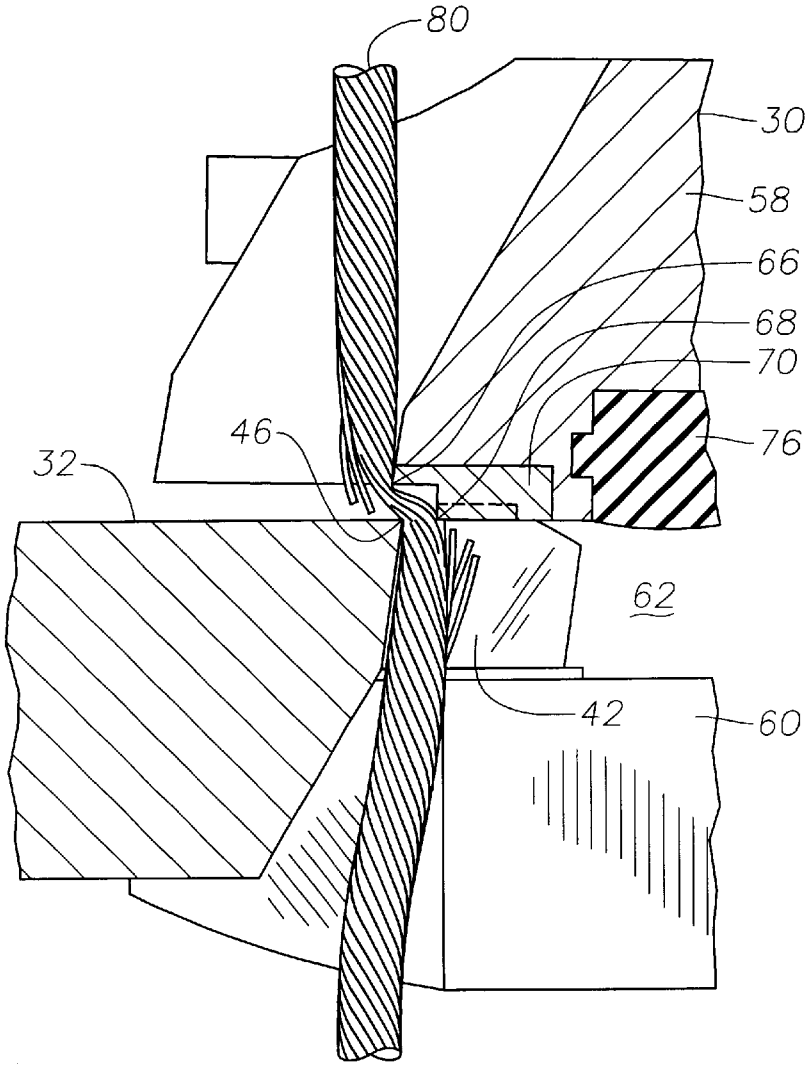
FIG. 8 is an exploded view of the double shearing rams showing the secondary shearing of a wire cable.
Figure 7:
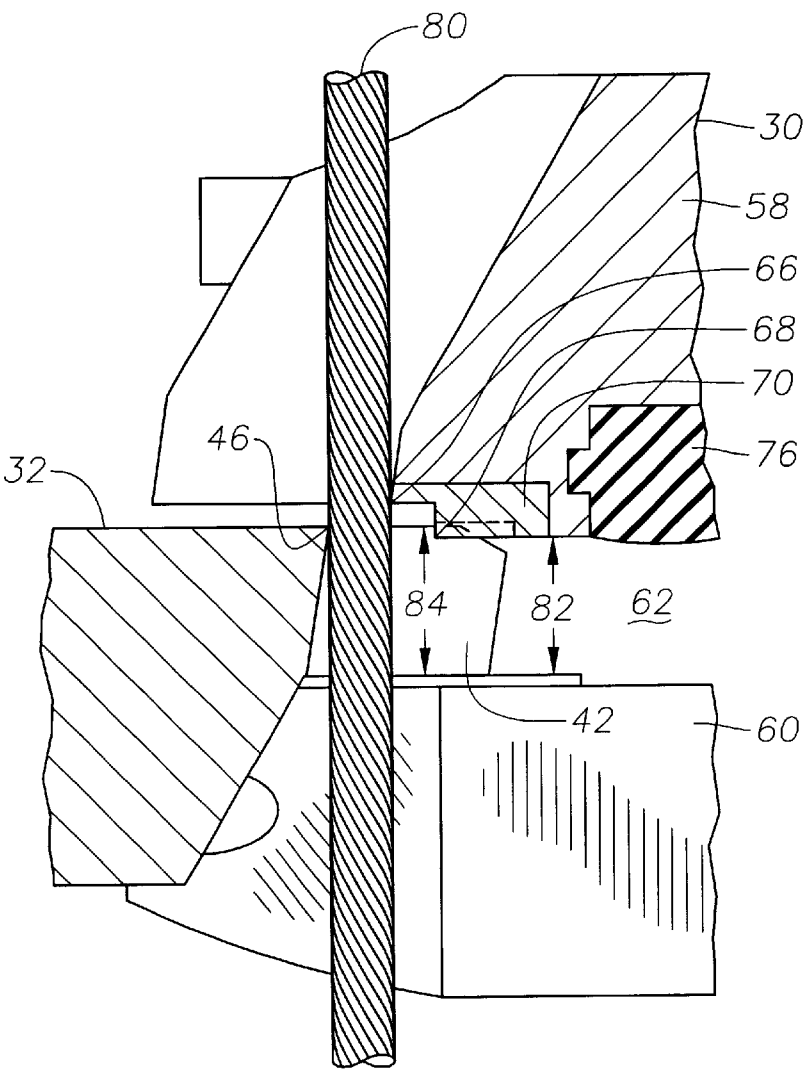
FIG. 7 is an exploded view of the double shearing rams showing the primary shearing of a wire cable.

FIGS. 7 and 8 show this shearing action in greater detail and demonstrate another unique aspect of the invention. As noticed previously, upper cutting blade 58 and lower guide blade 60 are vertically spaced apart to define cavity 62 that receives cutting blade 42 of lower shear ram 32. Cavity 62 is sized to have a height 82 slightly less than the thickness 84 of cutting blade 42. This height differential in cooperation with the positioning of primary cutting edge 66 and secondary cutting edge 68 of upper shear ram 30 aids in the shearing operation as follows. As shown in FIG. 7, notched cutting edge 46 of lower shear ram 32 has cable strand 80 is pressed against primary cutting edge 66 of upper shear ram 30 to perform the initial shear. Since cavity 62 is shorter than cutting blade 42 continued movement causes cutting blade 42 to force open cavity 62 as lower guide blade 60 deflects downwardly and increases height 82. This causes cutting blade 42 to be in very close engagement with secondary cutting edge 68 as it passes under secondary cutting edge 68. This ensures any strands of cable 80 not cut by the initial shear will be cut by the secondary shear. Also, the forcing open of cavity 62 causes upper cutting blade 58 and lower guide blade 60 to exert a large clamping force on cutting blade 42 to ensure a clean secondary shear.

Figure 9:
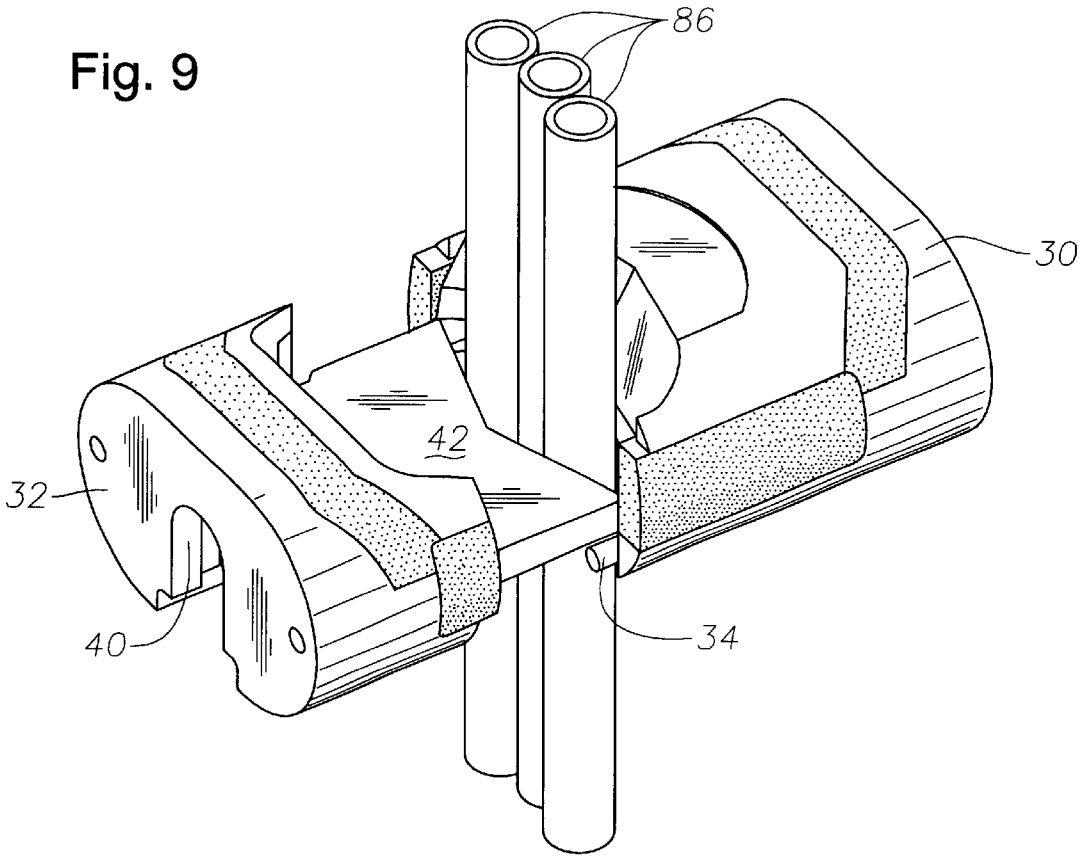
FIG. 9 is a perspective of the double shearing rams just prior to shearing of multiple tubing strings.
Figure 10:
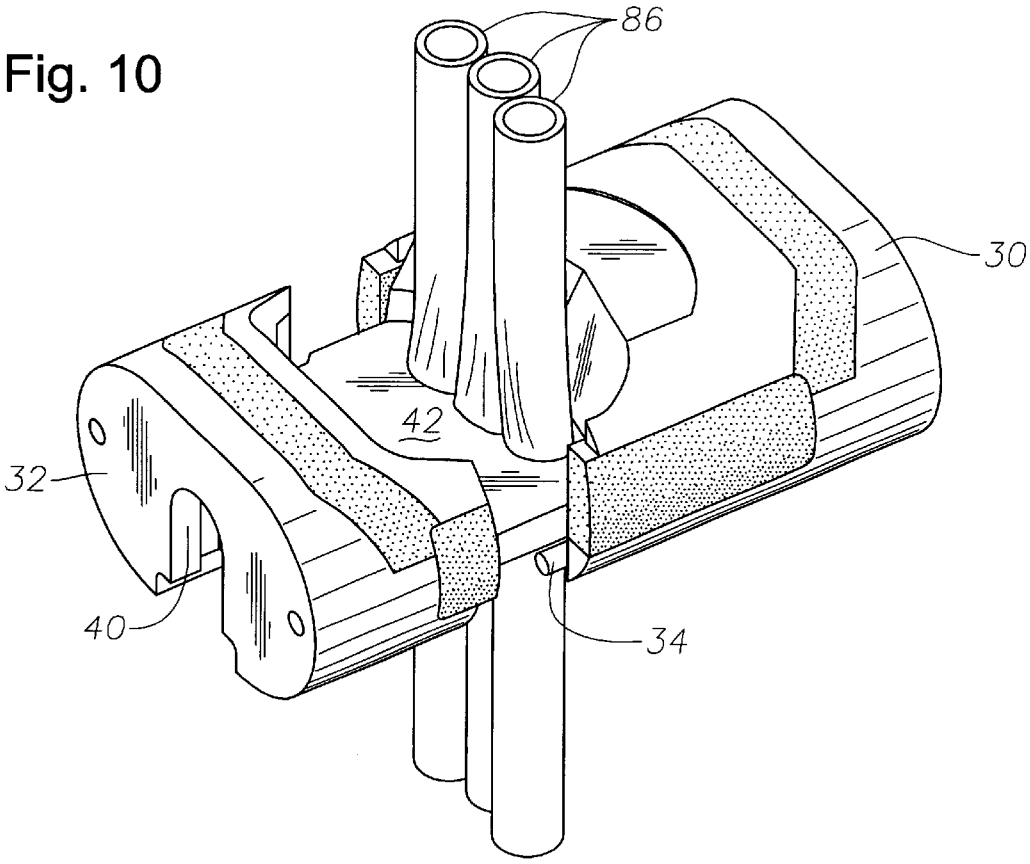
FIG. 10 is a perspective view of the double shearing rams after shearing of multiple tubing strings.

A further unique feature of the present invention is shown in FIGS. 9 and 10 that is most applicable to the shearing of steel and composite tubular members. Upper shear ram 30 and lower shear ram 32 are shown with multiple members, specifically multiple strings of tubing 86, positioned between them just prior to shearing. Guide pins 34 on upper shear ram 30 aid in keeping multiple tubing strings 86 in position until the outside ends of upper shear ram 30 cross over the outside ends of lower shear ram 32. As upper shear ram 30 and lower shear ram 32 are closed guide pins 34 in upper shear ram 30 contain the initial flattening and expanding of tubing strings 86 and ensure tubing strings 86 do not get "urged" out to the side and not be completely sheared.

The construction of my improved double shearing rams will be readily understood from the foregoing description and it will be seen that I have provided improved shear rams capable of performing a double shearing action on items to be sheared and thereby ensure complete and clean shearing of these members. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A ram-type blowout preventer for oil and gas drilling and workover operations including a pair of shear rams, comprising:

a body with a vertical bore;

a pair of opposing bonnet assemblies laterally disposed in said body;

a pair of opposing shear rams laterally moveable within said bonnet assemblies; and, said shear rams providing a double shearing of a member disposed within said vertical bore upon closing of said shear rams.

2. A ram-type blowout preventer for oil and gas drilling and workover operations including a pair of shear rams according to claim 1 wherein:

said pair of shear rams includes an upper shear ram and a lower shear ram.

3. A ram-type blowout preventer for oil and gas drilling and workover operations including a pair of shear rams according to claim 2, wherein:

said lower shear ram includes a cutting blade;

said lower shear ram cutting blade having a leading edge; and, said leading edge having a notched cutting edge thereon.

4. A ram-type blowout preventer for oil and gas drilling and workover operations including a pair of shear rams according to claim 3, wherein:

said upper ram includes an upper cutting blade and a lower guide blade;

said upper ram cutting blade having a leading edge;

said upper ram leading edge having a primary cutting edge formed thereon; and, said upper ram cutting blade having a secondary cutting edge formed thereon.

5. A ram-type blowout preventer for oil and gas drilling and workover operations including a pair of shear rams according to claim 4, wherein:

said upper ram cutting blade secondary cutting edge is axially and vertically displaced from said upper ram cutting blade primary cutting edge; and, said upper ram primary cutting edge and said secondary cutting edge having a notched configuration.

6. A ram-type blowout preventer for oil and gas drilling and workover operations including a pair of shear rams according to claim 5, wherein:

said upper ram upper cutting blade and said lower guide blade are vertically spaced to define a cavity therebetween; and, said cavity adapted to receive said lower shear ram cutting blade when said shear rams are closed.

7. A ram-type blowout preventer for oil and gas drilling and workover operations including a pair of shear rams according to claim 6, wherein:

said lower ram cutting blade configured to be an interference fit with said upper shear ram cavity and said upper shear ram upper cutting blade and said lower guide blade.

8. A ram-type blowout preventer for oil and gas drilling and workover operations including a pair of shear rams according to claim 7, wherein:

said upper shear ram lower guide blade including a plurality of guide pins positioned therein;

said lower shear ram including a plurality of guide holes positioned therein; and, said upper shear ram guide pins and said lower shear ram notched cutting edge cooperating during operation of said shear rams to retain a plurality of members to be sheared between said lower ram cutting blade and said upper ram cutting blade and guide blade and thereby facilitate shearing of said plurality of members.

9. A ram-type blowout preventer for oil and gas drilling and workover operations including a pair of shear rams according to claim 8, wherein:

said plurality of members to be sheared is in the form of at least one member selected from the group consisting of: seismic logging cable, steel tubing, steel pipe, wire rope, or composite fiber tubing.

10. A ram-type blowout preventer for oil and gas drilling and workover operations including a pair of shear rams according to claim 9, wherein:

said pair of opposing shear rams each include a top seal, a plurality of side packer seals, and a blade seal positioned thereon; and, said top seal, plurality of side packer seals, and blade seal positioned on said opposing shear rams seal said vertical bore of said ram-type blowout preventer body when said rams are operated to a closed position.

11. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams comprising:

an upper shear ram and a lower shear ram; and, said upper and lower shear rams providing a double shearing of a member disposed within said vertical bore upon closing of said shear rams.

12. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 11, wherein:

said lower shear ram includes a cutting blade;

said lower shear ram cutting blade having a leading edge; and, said leading edge having a notched cutting edge thereon.

13. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 12, wherein:

said upper ram includes an upper cutting blade and a lower guide blade;

said upper ram cutting blade having a leading edge;

said upper ram leading edge having a primary cutting edge formed thereon; and, said upper ram cutting blade having a secondary cutting edge formed thereon.

14. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 13, wherein:

said upper ram cutting blade secondary cutting edge is axially and vertically displaced from said upper ram cutting blade primary cutting edge; and, said upper ram primary cutting edge and said secondary cutting edge having a notched configuration.

15. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 14, wherein:

said upper ram upper cutting blade and said lower guide blade are vertically spaced to define a cavity therebetween; and, said cavity adapted to receive said lower shear ram cutting blade when said shear rams are closed.

16. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 15, wherein:

said lower ram cutting blade configured to be an interference fit with said upper shear ram cavity and said upper shear ram upper cutting blade and said lower guide blade.

17. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 16, wherein:

said upper shear ram lower guide blade including a plurality of guide pins positioned therein;

said lower shear ram including a plurality of guide holes positioned therein; and, said upper shear ram guide pins and said lower shear ram notched cutting edge cooperating during operation of said shear rams to retain a plurality of members to be sheared between said lower ram cutting blade and said upper ram cutting blade and guide blade and thereby facilitate shearing of said plurality of members.

18. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 17, wherein:

said plurality of members to be sheared is in the form of at least one member selected from the group consisting of: seismic logging cable, steel tubing, steel pipe, wire rope, or composite fiber tubing.

19. In a ram-type blowout preventer used in oil and gas drilling and workover operations including a body with a vertical bore, a pair of opposing bonnet assemblies laterally disposed in said body, and a pair of opposing shear rams laterally moveable within said bonnet assemblies, said shear rams according to claim 18, wherein:

said pair of opposing shear rams each include a top seal, a plurality of side packer seals, and a blade seal positioned thereon; and, said top seal, plurality of side packer seals, and blade seal positioned on said opposing shear rams seal said vertical bore of said ram-type blowout preventer body when said rams are operated to a closed position.

* * * * *